United States Patent [19]

Bagchi

[11] Patent Number: 4,933,270

[45] Date of Patent: Jun. 12, 1990

[54] PROCESS FOR THE PRECIPITATION OF STABLE COLLOIDAL DISPERSIONS OF BASE DEGRADABLE COMPONENTS OF PHOTOGRAPHIC SYSTEMS IN THE ABSENCE OF POLYMERIC STERIC STABILIZERS

[75] Inventor: Pranab Bagchi, Webster, N.Y.

[73] Assignee: Eastman Kodak Company, Rochester, N.Y.

[21] Appl. No.: 249,042

[22] Filed: Sep. 26, 1988

[51] Int. Cl.[5] ..... G03C 7/26; G03C 7/32

[52] U.S. Cl. ..... 430/546; 430/556; 430/557; 430/957

[58] Field of Search ..... 430/377, 546, 556, 557, 430/957; 252/312, 314, 346

[56] References Cited

U.S. PATENT DOCUMENTS

| | | | |
|---|---|---|---|
| 2,322,027 | 12/1940 | Jelley et al. | 430/546 |
| 3,765,897 | 10/1973 | Nittel | 430/546 |
| 3,860,425 | 1/1975 | Ono et al. | 430/546 |
| 3,936,303 | 2/1976 | Shiba et al. | 430/546 |
| 4,106,940 | 8/1978 | Langen et al. | 430/546 |
| 4,349,455 | 9/1982 | Yamamura et al. | 252/312 |
| 4,388,403 | 6/1983 | Helling et al. | 430/546 |
| 4,464,464 | 8/1984 | Matejec et al. | 430/546 |
| 4,539,139 | 9/1985 | Ichikawa et al. | 252/314 |
| 4,554,247 | 11/1985 | Yamashita et al. | 430/622 |
| 4,840,881 | 6/1989 | Watanabe et al. | 430/512 |

FOREIGN PATENT DOCUMENTS

| | | |
|---|---|---|
| 182658 | 5/1986 | European Pat. Off. . |
| 139532 | 12/1978 | Japan . |
| 1193349 | 10/1967 | United Kingdom . |

OTHER PUBLICATIONS

Research Disclosure 16468 12/77.
Research Disclosure 19532 7/80.
Chem. Abstracts vol. 95, No. 15925R, Lev, et al.

*Primary Examiner*—Paul R. Michl
*Assistant Examiner*—Patrick A. Doody
*Attorney, Agent, or Firm*—Paul A. Leipold

[57] ABSTRACT

The invention provides a method of forming a dispersion of base degradable hydrophobic component for a photographic system. The invention is accomplished by mixing the component, solvent, and surfactant, at an elevated temperature if necessary, metering the mixture of solvent, surfactant, and hydrophobic component to an excess of water with agitation so as to precipitate from the water solvent solution small particles of the hydrophobic component. The small particles then form a stable dispersion, after washing by dialysis or diafiltration, that will not agglomerate during storage prior to use. The preferred photographic component for use in the system of the invention is an ester terminated photographic coupler that would decompose if subjected to the high pH treatment of prior art procedures.

19 Claims, 2 Drawing Sheets

PROCESS FOR THE PRECIPITATION OF STABLE COLLOIDAL DISPERSIONS OF BASE DEGRADABLE COMPONENTS OF PHOTOGRAPHIC SYSTEMS IN THE ABSENCE OF POLYMERIC STERIC STABILIZERS

FIELD OF THE INVENTION

The present invention concerns a method for forming dispersed particles of base degradable photographic components for photographic systems. It particularly relates to the dispersion of photographic coupler materials that would be degraded if present in highly alkaline solution.

PRIOR ART

The art of precipitation of hydrophobic components of photographic systems, starting from a solution state, to a stable fine particle colloidal dispersion is known. This is generally achieved by dissolving the coupler in a water-miscible solvent aided by addition of base to ionize the coupler, addition of a surfactant with subsequent precipitation of the photographic component by lowering the pH, or by shift in concentration of &he two or more miscible solvents, such that the photographic component is no longer soluble in the continuous phase and precipitates as a fine colloidal dispersion.

In United Kingdom Patent No. 1,193,349, Townsley et al discloses a process whereby a color coupler is dissolved in a mixture of water-miscible organic solvent and aqueous alkali. The solution of color coupler is then homogeneously mixed with an aqueous acid medium including a protective colloid. Thus was formed a dispersion of precipitated color coupler by shift of PH, and this dispersion of color coupler when mixed with a dispersion of an aqueous silver halide emulsion and coated on a support, was incorporated into a photographic element.

In an article in *Research Disclosure* 16468, December 1977, pages 75–80 entitled "Process for Preparing Stable Aqueous Dispersions of Certain Hydrophobic Materials" by W. J. Priest, a method of forming stable aqueous dispersions of hydrophobic photographic material was disclosed. The process of Priest involves the formation of an alkaline aqueous solution of an alkali soluble color-forming coupler compound in the presence of a colloid stabilizer or polymeric latex. The alkali solution is then made more acidic in order to precipitate the hydrophobic protonated color-forming coupler compounds. The droplets of color-forming coupler compounds are stabilized against excessive coagulation by adsorption of a colloid stabilizer.

U.S. Pat. No. 4,388,403—Helling et al discloses a process of preparation of dispersions of hydrophobic substances in water. In Helling et al the dispersions of hydrophobic substances in water are prepared by dissolving the hydrophobic substance together with an ionic polyaddition or condensation product in an organic, water-miscible solvent or a mixture of such a solvent with water, diluting the solution with water and removing the organic solvent. This Process is a preparation that causes the particle formation by solvent shift of the solution. Helling et al suggests utilization of the Process for preparation of photographic recording materials.

Japanese Patent No. 53 139532 (1978)—Iwao et al discloses a method for preparing dispersions in which a dye image precursor is dissolved in a water-miscible organic solvent, and then said solution is mixed with an aqueous solution containing a surfactant in order to precipitate the water-insoluble dye image precursor as a dispersion. It is further required in Iwao et al that the process be carried out in the "virtual absence" of a polymer with a number average molecular weight of 2,000 or above.

While the above processes have been somewhat successful with some color photographic materials, there still remain difficulties in obtaining dispersions of couplers that are degradable in base solution. Generally use of polymeric steric stabilizers, such as polyvinyl pyrrolidone (PVP), leads to reduction of activity of the formed coupler dispersions. The process of using pH shift to cause particle precipitation by changing an alkaline solution to an acidic solution is clearly unsatisfactory for photographic materials that will degrade in basic solutions. Those processes dealing with particle formation by shift of the concentration of the solvent have difficulty in the excessive use of surfactants, uncertain control of particle growth, and inability of many water-miscible solvents to successfully dissolve large proportions of the couplers. The procedure of the Iwao et al patent, which involves dissolving in only an organic solvent, will be unable to achieve high loading of the hydrophobic component in the solvent, thereby dramatically increasing Production cost, as a large amount of solvent must be handled in order to achieve the dispersion of a small amount of hydrophobic component particles.

THE INVENTION

The invention provides a method of forming a dispersion of base degradable hydrophobic component for a photographic system. The invention is accomplished by mixing the component, solvent, and surfactant, then metering the mixture of solvent, surfactant, and hydrophobic component into an excess of water with agitation so as to precipitate from the water-solvent solution small particles of the hydrophobic component. After washing by diafiltration or by dialysis to remove the water-miscible solvent, the small particles form a stable dispersion that will not agglomerate during storage Prior to use. The preferred photographic component for use in the system of the invention is an ester-terminated photographic coupler that would hydrolyze in alkaline solutions used in prior art procedures.

MODES OF PREFORMING THE INVENTION

Figure 1:
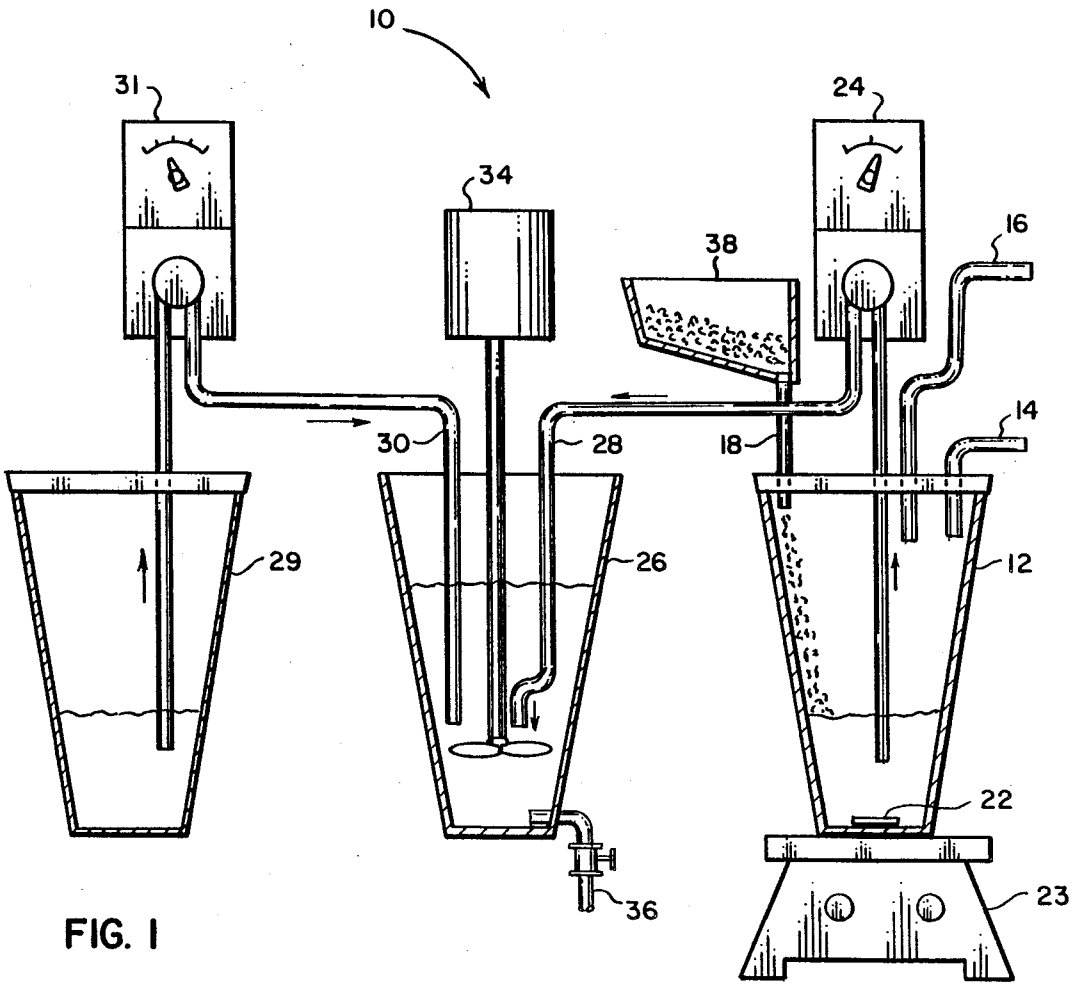
FIGS. 1 and 2 illustrate schematically apparatus for carrying out the process of the invention.

The invention has numerous advantages over the prior art, particularly the process of Japanese Patent No. 53-139532 (1978)-Iwao et al. Addition of the surfactant to the solvent increases the solubility of the coupler in the solvent by greater than 100%. Therefore, a less potent solvent can be utilized, preventing ripening or particle growth after precipitation of the coupler in fine dispersion state. The particles formed by the system of the invention are more uniform in size than those formed by milling processes. The process of the invention may be formed generally in the ambient conditions and does not require special cooling in order to maintain control of the process. These and other advantages will become apparent from the detailed description below.

In the drawing, apparatus 10 may be utilized in performing the process of the invention. To container 12 is added a solvent, surfactant (preferably in aqueous solution), and a dry photographic system component, from inlet devices 14, 16, and 18. The dry photographic system component is stored in container 38. The mixture of the solvent, surfactant, and photographic component are mixed by agitator 22 to form a clear solution when heated to the desired temperature in container 12. After mixing, the materials are pumped by pump 24 into tank 26 through inlet 28. Tank 26 contains water fed through inlet 30. As the mixture of solvent, surfactant, and photographic component is added via inlet 28 to the tank 26, and agitated by stirrer 34, particles precipitate out in stable, fine dispersion form. The dispersion of these particles may be removed through outlet 36 for washing to remove the solvent by ultrapiltration or dialysis and then for treatment to form a photographic element.

Figure 2:
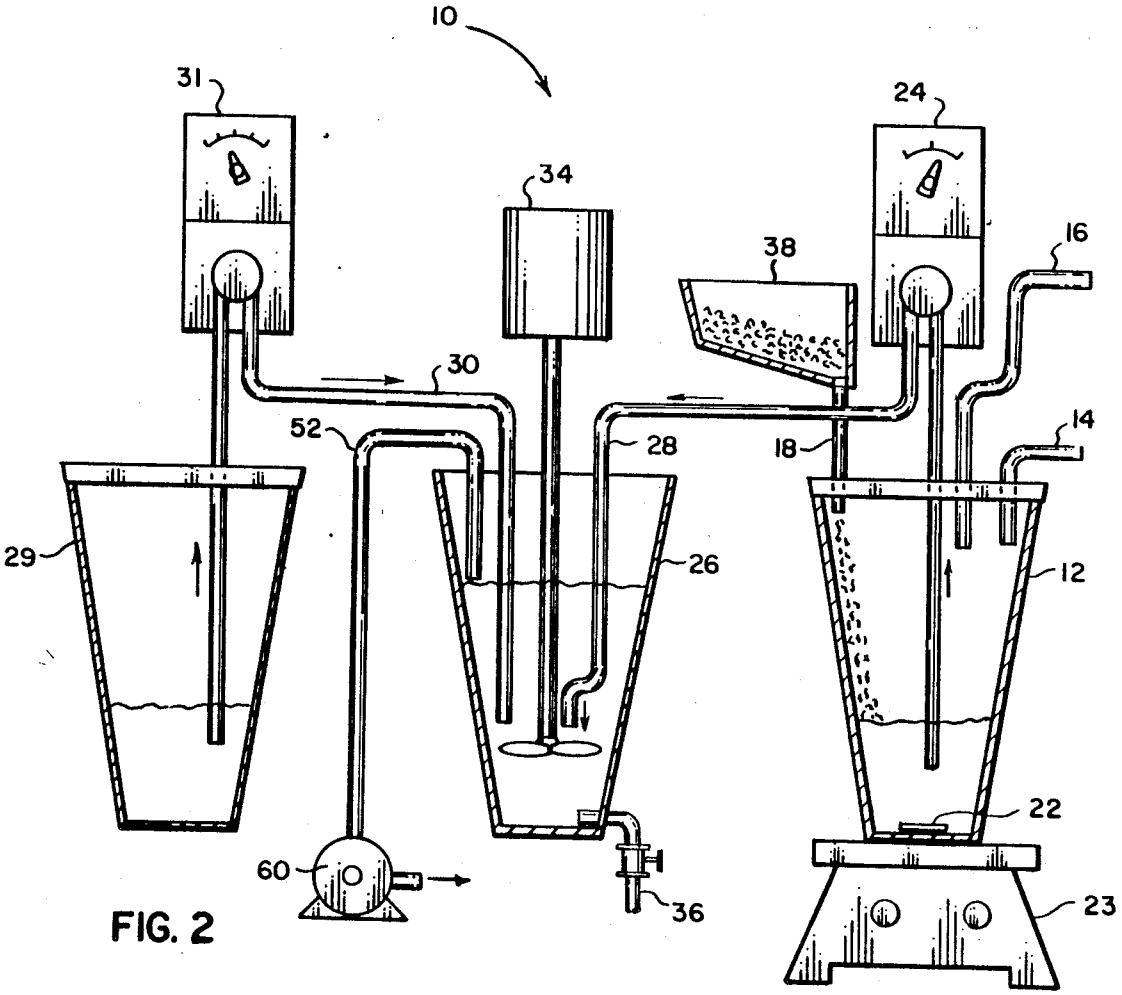

The above description is that of a semicontinuous batch process. This process can be very easily converted to a continuous manufacturing process using apparatus 50 described in FIG. 2, using the Example 1 of Table I. In Example 1, the density of the coupler solution, which is made up of 20 g of coupler, 80 g of propanol, and 15 g of 33% Aerosol A102 solution, is about 0.8 g/ml. Its total weight being 115 g, its volume is 115/0.8=144 ml. Total volume of the final dispersion in the formulation is, therefore, 600 ml+144 ml=744 ml. Tube 52 is inserted into the reaction kettle 26 to a level such that its end touches the liquid level when the dispersion volume in the kettle is 744 ml. This is the residence volume of the reaction kettle 26. When a ratio of 600 ml of water to 144 ml of coupler solution and a coupler flow rate of 20 ml/min. is used, a water flow rate of (600×20)/144=83 mg/min. is necessary. Total dispersion formation rate in the kettle is 20+83=103 mg/min. Therefore, to maintain a constant volume in the reactor, the dispersion withdrawal pump 60 is set at 103 mg/min to remove the formed dispersion from the reaction kettle 26.

To start the process, the reaction vessel 26 is emptied by opening valve in outlet 36, which is then closed. The coupler solution pump 24 at 20 ml/min. and the water pump 31 at 83 ml/min. are started simultaneously. Dispersion is formed in the reaction kettle 26 as described before. The dispersion is withdrawn via pump 60 started soon after the start of the process. The moment the dispersion volume in the reaction kettle reaches 744 ml, as determined by the level of outlet 52 in the reaction vessel, the formed dispersion is pumped out via outlet 52 for diafiltration and concentration to ~15% coupler suitable for subsequent formulation into an element of a photographic system. In this concept a residence volume of 744 ml is used. It can be chosen to be any convenient volume to suit production conditions.

Any solvent that will dissolve the photographic component without degradation of the component and that is miscible with water is suitable for the invention. Typical of such solvents are acetone, methyl alcohol, ethyl alcohol, isopropyl alcohol, tetrahydrofuran, dimethylformamide, dioxane, N-methyl-2-pyrrolidone, acetonitrile, ethylene glycol, ethylene glycol monobutyl ether, diacetone alcohol, etc. A preferred solvent is n-propanol because n-propanol allows the particles to stay dispersed longer after formation.

The surfactant suitable in the process may be any surfactant that allows increased solubility of the photographic component in the solvent, as well as adding stability to the final dispersion of particles. Generally the surfactant contains a hydrocarbon chain comprising about 6 to about 24 carbon atoms and at least 3 oxyethylene groups and preferably having two negative charges at the hydrophilic end of the surfactant. A preferred group of surfactants has been found to be the disodium ethoxylated C-10 to C-12 alcohol half esters of sulfosuccinic acid, as these surfactants give dispersions that are stable and allow a higher concentration of the photographic component to be dissolved in the solvent. A particularly preferred surfactant has been found to be the surfactant available as Aerosol A102 from Cyanamid that has the formula as set forth below.

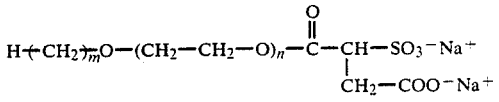

m = 10–12, n = 3–5
Aerosol A102

Other suitable surfactants are Aerosol A103 from Cyanamid and Polystep B23 from Stepan Chemical having the following formulas:

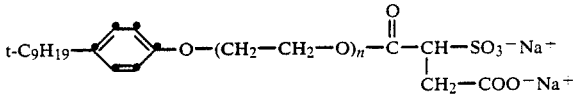

n = 5–10
Aerosol A103

$n\text{-}C_{12}H_{25}-O-(CH_2CH_2-O)_{12}-SO_3^-Na^+$
Polystep B23

The hydrophobic photographic components that are suitable for the dispersion formation method of the invention are those having groups that are destroyed in base solutions. Typical of such materials are those photographic components that contain terminal ester groups, such as those illustrated in the structures below. The method of the invention has been found to be particularly preferred for ester-terminated photographic couplers and image modifying (DIR and DIAR) couplers. The base hydrolyzable group that will decompose in a base solution is underlined.

1.
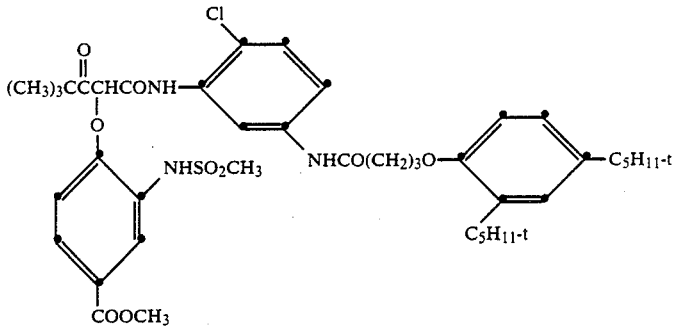
2.
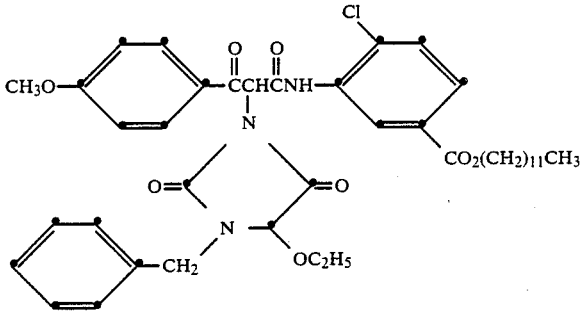
3.
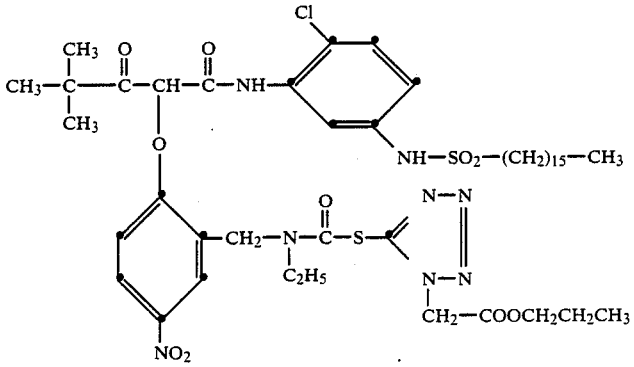
4.
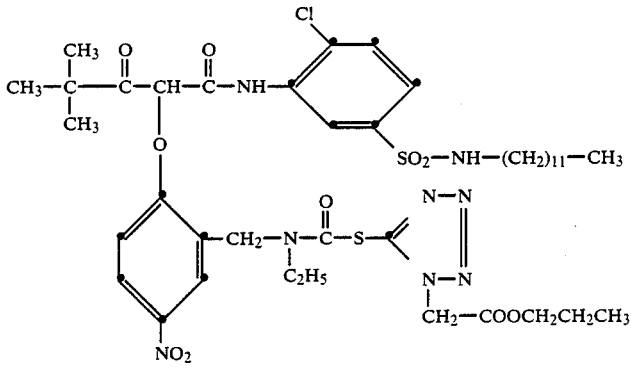
5.
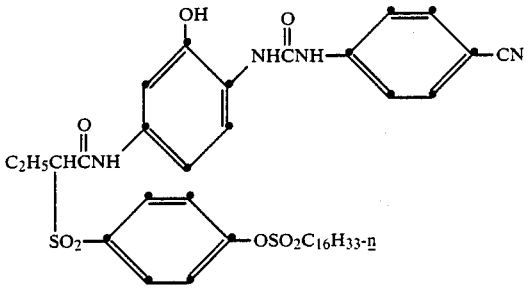

-continued
6.
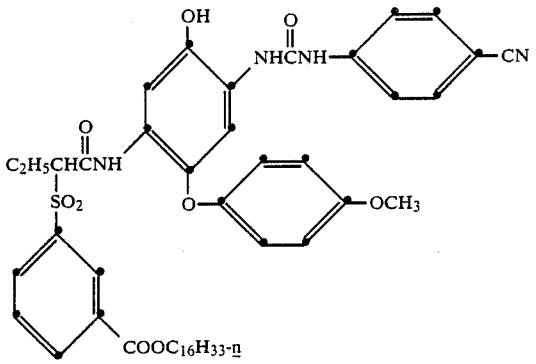
7.
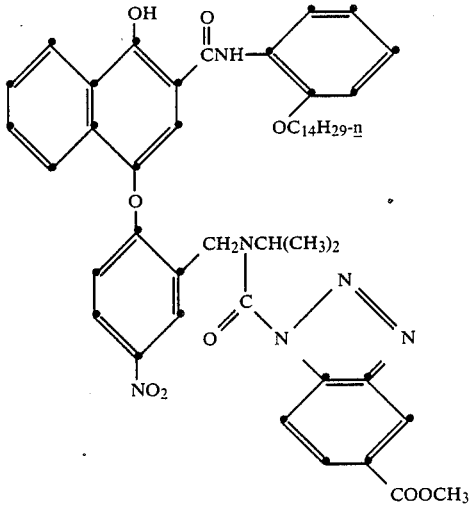
8.
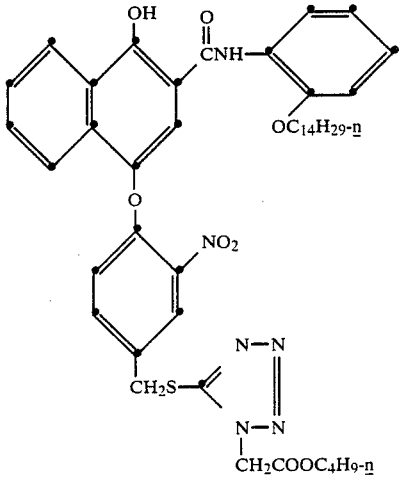

-continued
9.
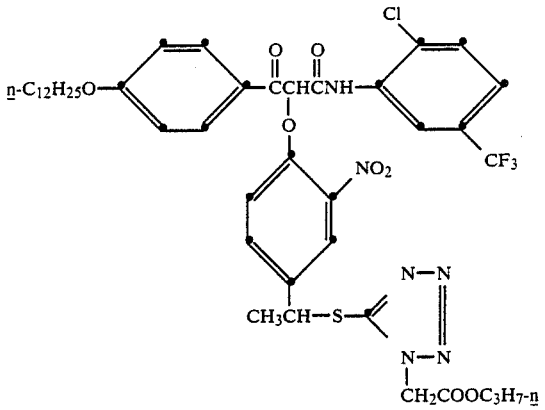
10.
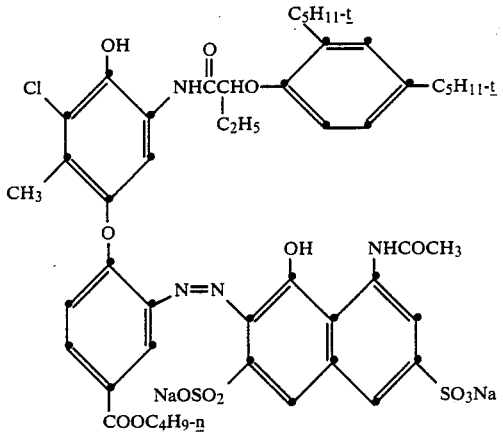
11.
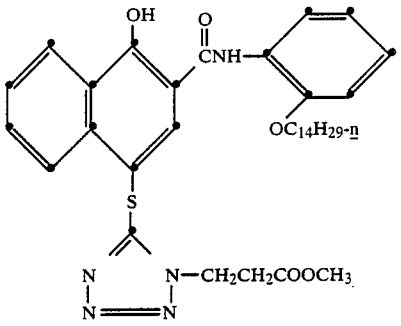
12.
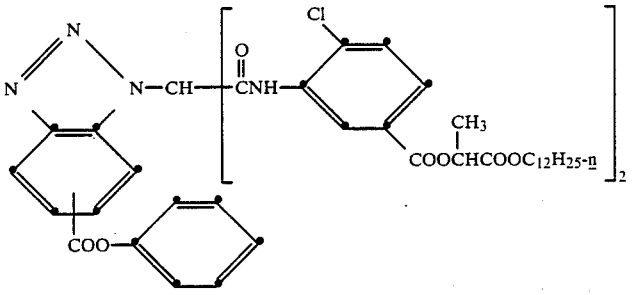

-continued
13.
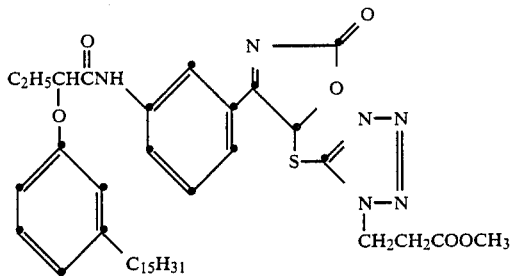
14.
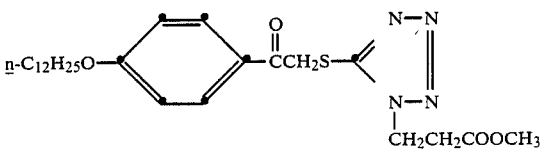
15.
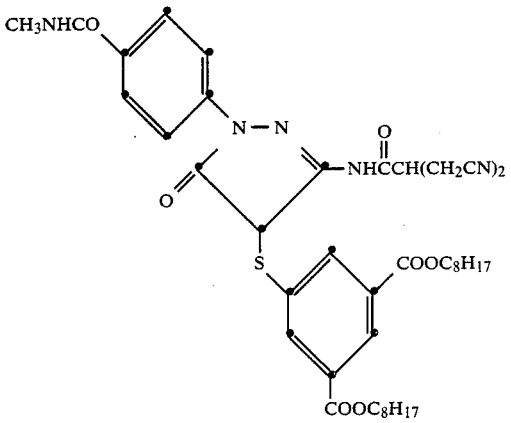
16.
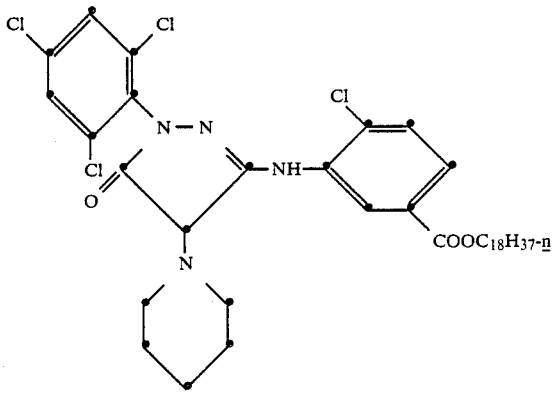

-continued

17.

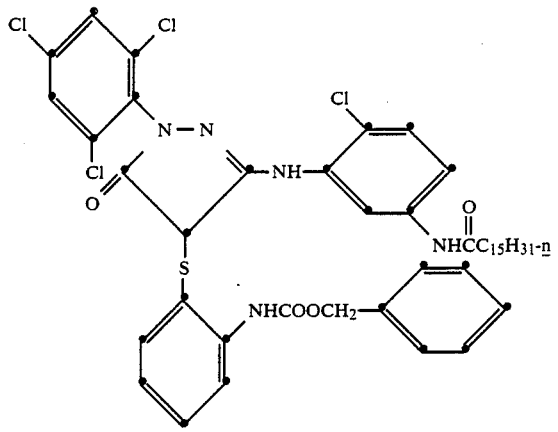

18.

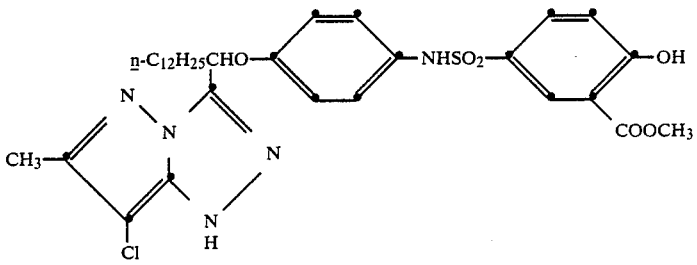

19.

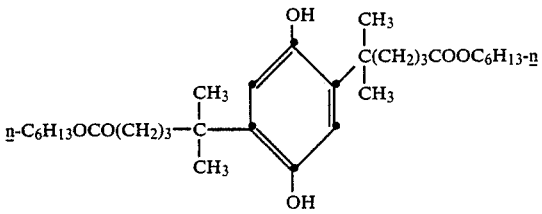

20.

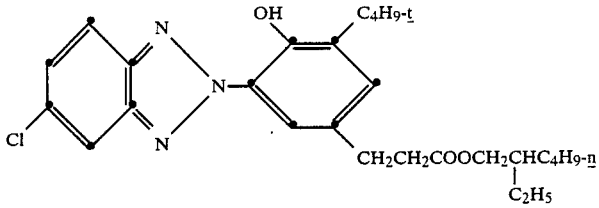

These ester-terminated compounds are not suitable for pH shift particle formation processes as they will degrade in base compositions.

The following examples are representative of the process of the invention and are not intended to be exhaustive of the possibilities of the invention. Parts and percentages are by weight unless otherwise indicated.

EXAMPLES 1-4

Preparation of Dispersions of a Yellow Dye-Forming Coupler

Four dispersions of Coupler 2 above were prepared by the following procedure: To 20 g Coupler 2 was added 80 g n-propanol and the amount shown in Table I of a 33% active solution of Aerosol A102 (Disodium ethoxylated C-10 to C-12 alcohol half ester of sulfosuccinic acid, made by Cyanamid). The mixture was heated to 65° C., with stirring to dissolve the coupler. The hot coupler solution was then pumped at 20 ml/min. into 600 g of water in the reactor with stirring. The precipitation chamber was kept at room temperature.

Solvent was removed from the dispersions by continuous dialysis against distilled water. The particle sizes shown in Table I were determined by photon correlation spectroscopy (PCS), an analytical method described in "Laser Light Scattering" by B. Chu, Academic Press, N.Y. (1974). The repeat makes are reproducible in terms of composition and particle size. It appears that increase in the surfactant concentration leads to slight increase in particle size probably due to ripening by the solubilizing surfactant. A high pressure liquid chromatography of the Example 1 dispersion indicated no decomposition compared to the pure coupler.

TABLE I

Preparation Conditions and Physical Properties of Coupler 2 Dispersions

| Example | Coupler Solution Components (Grams) Coupler 2 | normal propanol | 33% aqueous Al02 soln. | Final Coupler 2 conc. % | Al02 conc. % | PCS* Particle Diameter (nm) |
|---|---|---|---|---|---|---|
| 1 | 20 | 80 | 15 | 1.7 | 0.17 | 212 |
| 2 | 20 | 80 | 15 | 1.7 | 0.17 | 234 |
| 3 | 20 | 80 | 30 | 1.9 | 0.25 | 237 |
| 4 | 20 | 80 | 45 | 1.7 | 0.35 | 250 |

*Photon Correlation on Spectroscopy

EXAMPLES 5–10

Photographic Testing of Experimental Dispersion

Photographic elements were prepared using the following coating format in which the no-solvent dispersion of the invention was compared with a conventional coupler solvent dispersion of the same coupler prepared by the method of Fierke and Chechak described in U.S. Pat. No. 2,801,171 (components are given in mg/m$^2$).

Overcoat Layer: Gelatin - 2691, Hardener at 1.8% of total gelatin
Emulsion Layer: Gelatin - 2691, Blue-sensitized silver bromoidide emulsion (as silver) - 646, Coupler 2 and DIR Compound 3 as shown in Table II
Support: Gelatin - 4887 on Cellulose Triacetate Strips of each element were step-exposed to white light and processed in a Kodacolor C41 process as described in the British Journal of Photography Annual, 1982, pp. 209–211. Reading the processed strips with blue light gave the results reported in Table II, where G (gamma) is the contrast of the straight-line portion of the sensitometric curve and % G is a measure of the effectiveness of the DIR Compound 3 in repressing this contrast. It is calculated as % $G=100\times(1-G_{DIR}/G_{NONE})$, where $G_{DIR}$ is the contrast with the DIR compound present and $G_{NONE}$ is the contrast using the same coupler dispersion in the absence of DIR compound.

TABLE II

| Example | Coupler 2/ DBP* | DIR-3/DBP* | G | % G |
|---|---|---|---|---|
| 5 Comparison | 646/323 | — | 1.90 | 0 |
| 6 Comparison | 646/323 | 65/65 | 1.60 | 16 |
| 7 Invention | 646/0 | — | 1.55 | 0 |
| 8 Invention | 646/0 | 32/32 | 1.41 | 9 |
| 9 Invention | 646/0 | 65/65 | 1.21 | 22 |
| 10 Invention | 646/0 | 97/97 | 1.07 | 31 |

*Amounts are in mg/m$^2$: DIR Compound 3 was dispersed in an equal weight of dibutyl phthalate (DBP); Coupler 2 (comparison) was dispersed in half its weight of dibutyl phthalate.

It can be seen from the results in Table II that although the dispersion according to the invention is slightly less active than the conventional dispersion, it is still very active for a non-solvent dispersion. It is noteworthy that the same amount of DIR Produces a gamma suppression of 22% with the Coupler 2 dispersion of the invention (Example 9), while it gives only 16% with the conventional dispersion (Example 6). The advantage is that less DIR compound is needed: an estimated 50 mg/m$^2$ of the DIR using the inventive dispersion should produce the effect of 65 mg/m$^2$ of the same DIR compound in the comparison coupler dispersion.

EXAMPLES 11 and 12

Demonstration of Decomposition in High pH Solution of a Photographic Compound Containing an Ester Terminal Group The Procedure of Priest described in *Research Disclosure* 16468, cited above, requires that the photographic component be dissolved, often with heating, in an alkaline solution with pH as high as 13.5. The following experiment demonstrates that a photographic component containing an ester terminal group will decompose under such harsh conditions and, therefore, should be dispersed under the milder conditions described in this invention:

Example 11 (basic solution): a 1 g sample of Coupler 2 was dissolved in a solution containing 0.1 g NaOH, 15 g n-propanol, and 5 g distilled water. Example 12 (no base): a 1 g sample of Coupler 2 was dissolved in 15 g n-propanol and 5 g distilled water. Each solution was held at 60° C. for 3 hours and then analyzed by high pressure liquid chromatography (HPLC). The HPLC trace of Example 12 showed the same two major peaks (at about 17 and 19 min. retention times) as a fresh sample of Coupler 2, but the HPLC trace of Example 11 showed severe decomposition had occurred, since the characteristic peaks for this compound were gone and replaced by a multiplet of peaks at lower retention times indicating the presence of many smaller fragments.

The above examples are intended to be illustrative of the process of the invention. For instance, while only illustrated with yellow couplers, the invention could be utilized with magenta or cyan couplers that are ester or peptide terminated. The invention has been described in detail with particular reference to preferred embodiments thereof, but it will be understood that variations and modifications can be effected within the spirit and scope of the invention that is intended to be referred by the scope of the claims attached hereto.

I claim:

1. A method of forming a dispersion of a base degradable hydrophobic component for a photographic system comprising mixing water-miscible solvent, surfactant, and said hydrophobic component, metering the solution of said solvent, surfactant and hydrophobic component into an excess of water with agitation, such that the said hydrophobic component precipitates in a fine stable colloidal dispersion, and recovering the fine particle dispersion of said hydrophobic component.

2. The method of claim 1 wherein said base degradable hydrophobic component comprises an ester terminated photographic coupler.

3. The method of claim 1 wherein said solvent comprises n-propyl alcohol.

4. The method of claim 1 wherein said surfactant comprises an alkyl or aryl ethoxylated half ester of sulfosuccinic acid.

5. The method of claim 2 wherein the ester-terminated photographic coupler is selected from the group consisting of

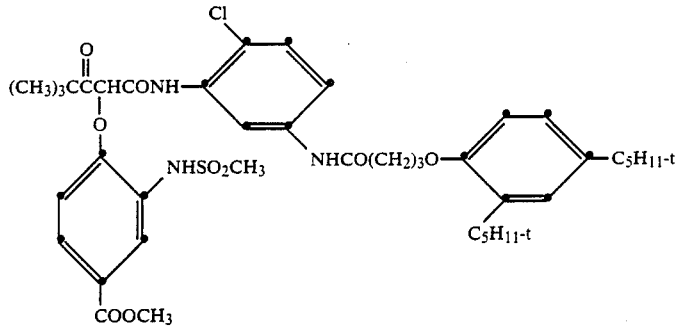

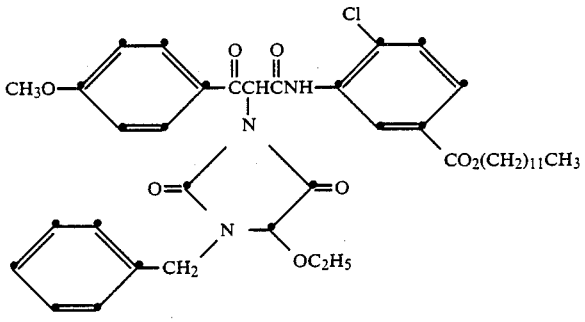

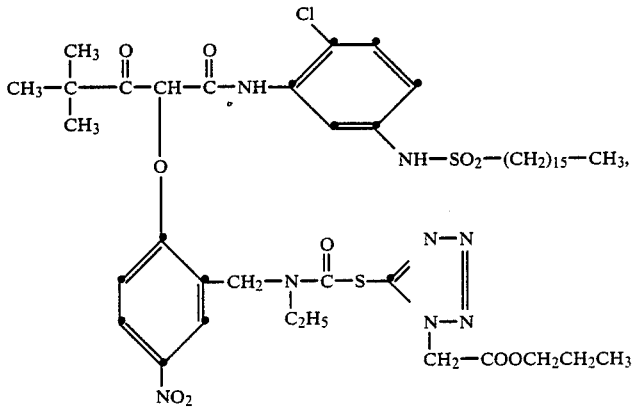

and

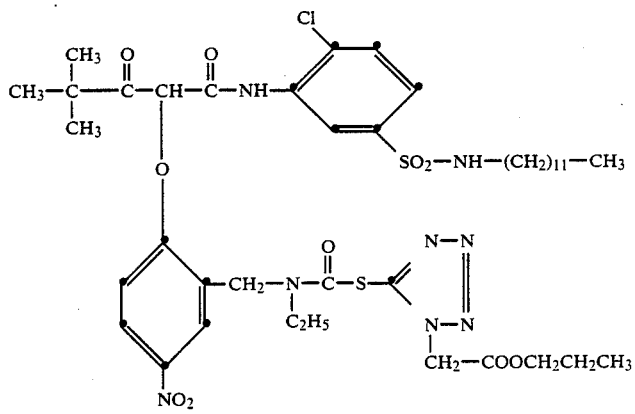

6. The method of claim 1 wherein said surfactant comprises disodium ethoxylated C-10 to C-12 alcohol half esters of sulfosuccinic acid.

7. The method of claim 1 wherein said particles in dispersion are concentrated by dialysis or diafiltration.

8. The method of claim 1 wherein said process is performed in a continuous manner.

9. The method of claim 1 wherein the method is performed in a semicontinuous manner.

10. The method of claim 1 wherein during said mixing of solvent, surfactant, and hydrophobic component the mixture is heated.

11. The method of claim 1 wherein said base degradable hydrophobic component is selected from the group consisting of DIR and DIAR image modifying couplers.

12. The method of claim 1 wherein said solvent comprises n-propyl alcohol and said hydrophobic component comprises an ester terminated photographic coupler.

13. The method of claim 5 wherein said solvent comprises n-propanol.

14. The method of claim 7 wherein said particles are concentrated by dialysis to a concentration of about 15 percent coupler.

15. The method of claim 2 wherein said particles in dispersion are concentrated to 15 percent coupler.

16. The method of claim 2 wherein said surfactant comprises a hydrocarbon chain comprising about 6 to about 24 carbon atoms and at least 3 oxyethylene groups.

17. The method of claim 2 wherein said surfactant comprises disodium ethoxylated C-10 to C-12 alcohol half esters of sulfosuccinic acid.

18. A method of forming a dispersion of a base degradable hydrophobic photographic coupler for a photographic system consisting essentially of mixing water miscible solvent, surfactant, and said coupler;

metering the solution of said solvent, said surfactant, and said coupler into an excess of water with agitation to precipitate fine particles of said coupler;

recovering the fine particle dispersion of said coupler.

19. The method of claim 18 wherein said solvent comprises n-propyl alcohol, said hydrophobic component comprises an ester terminated photographic coupler, and said surfactant comprises a hydrocarbon chain comprising about 6 to about 24 carbon atoms and at least 3 oxyethylene groups.

* * * * *